US006328299B1

(12) United States Patent
Coombs

(10) Patent No.: US 6,328,299 B1
(45) Date of Patent: Dec. 11, 2001

(54) MOVING SHELF SET FINISHING MAILBOX

(75) Inventor: Peter M Coombs, Tustin, CA (US)

(73) Assignee: GRADCO (Japan) Ltd, Tokyo (JP)

( * ) Notice: Subject to any disclaimer, the term of this patent is extended or adjusted under 35 U.S.C. 154(b) by 0 days.

(21) Appl. No.: 09/616,312

(22) Filed: Jul. 17, 2000

(51) Int. Cl.[7] ..... B65H 37/04

(52) U.S. Cl. ..... 270/58.08; 270/58.15; 270/58.11; 399/410; 271/294

(58) Field of Search ..... 270/58.08, 58.11, 270/58.12, 58.13, 58.14, 58.15; 399/410; 271/292, 293, 294

(56) References Cited

U.S. PATENT DOCUMENTS 5,098,074 * 3/1992 Mandel et al. ..... 270/58.13
5,125,634 * 6/1992 Lawrence ..... 270/58.15
5,201,517 * 4/1993 Stemmle ..... 271/291
5,236,189 * 8/1993 Ikoma ..... 271/292
5,984,299 * 11/1999 Hirota et al. ..... 271/292 X

FOREIGN PATENT DOCUMENTS 10-258957 * 9/1998 (JP) .
2001-48410 * 2/2001 (JP) .
2001-106423 * 4/2001 (JP) .

* cited by examiner

*Primary Examiner*—Christopher P. Ellis
*Assistant Examiner*—Patrick Mackey

(57) ABSTRACT

A moving shelf set finishing mailbox has a plurality of trays vertically movable by rotatable cams to opposite sides of a sheet inlet location from which sheets are supplied serially from a copier or printer, the sheets being supported at their trailing edge on a shelf integral with the tray and their forward ends being supported by the tray and by any underlying sheets. The trays are sequentially or randomly moved by the rotary cams and when randomly moved, the apparatus functions as a mailbox in which the sheets are stapled while the trailing edges are supported on the shelf and the sets are moved by pushers from the shelf by pushers so that the trailing end of the sets are finally supported by the tray.

12 Claims, 3 Drawing Sheets

MOVING SHELF SET FINISHING MAILBOX

BACKGROUND OF THE INVENTION

In the office environment, it is often desirable to provide a machine which can function to sort the output from a copier or printer into trays to which the sheets may be serially fed for collation or randomly fed for mailboxing, or in the case of digital copying or printing, for receiving the sets in collated fashion.

Typically, sorting mailbox machines may be provided with fixed receiving trays to which the sheets are supplied either serially or randomly for mailboxing purposes, as for example, shown in my prior U.S. Pat. No. 5,938,194 granted Aug. 17, 1999 and other prior art patents, which, in a generic sense, function to receive sheets of paper fed from the printer or copier to a moving inlet feed path which is vertically displacable or to a feed path which includes gates for deflecting sheets from the feed mechanism into the trays.

On the other hand, as represented by Lawrence U.S. Pat. No. 4,843,434 granted Jun. 27, 1989, the sheets may be fed to trays which are opened by a moving bin opener which may be vertically positioned to open a selected tray and the infeed moves with the bin opener.

Various other examples of sheet receiving, sorting or mailboxing machines are known for selectively receiving the output from the sheet printing or copying apparatus. Canon U.S. Pat. No. 5,385,340 granted Jan. 31, 1995 and Lawrence U.S. Pat. No. 5,649,695 granted Jul. 22, 1997 disclose examples of paper receiving or stacking devices which assemble and finish a stapled set of sheets by means which in a preliminary stage, assembles the trailing ends of the sheets on a shelf while the leading ends of the sheet are otherwise supported.

In the Canon structure, the set of sheets is supported at its trailing end on a fixed shelf from which the assembled set is pushed to a receiver.

In the Lawrence structure, the assembled set of sheets is gripped and moved to a finishing station after accumulation of the trailing ends of the sets on a movable shelf.

My pending application, Ser. No. 078,202, filed May 14, 1998 is co-owned herewith and discloses a stacker with which are associated a binding station and a stapling station. In that application there is also disclosed a shelf which receives the trailing ends of sheets being accumulated for processing at either of the binding or stapling stations, wherein the shelf is allowed to pivot downwardly to drop the trailing ends of the accumulated set of sheets.

In my pending application, Ser. No. 280,599, filed Mar. 29, 1999, co-owned herewith, there is disclosed a stapling stacker in which the trailing ends of the sheets fed through are supported on an L-shaped shelf, while the leading ends of the sheets are supported on a previously stacked set, wherein the sets are side edge aligned, stapled and offset with respect to previously stapled sets, and the shelf is then pivotally dumped to deposit the set on the stacker or on the previously stacked sets.

None of these prior patents addresses the need for being able to finish or staple the sets in an apparatus of the type in which the receiving trays are vertically movable past a sheet inlet by operating cam structures as illustrated for example, in my prior U.S. Pat. No. 5,255,902 granted Oct. 26, 1993. In this patent, a set of trays can be successively moved upwardly or downwardly by means including a pair of spiral cams rotatable by a pair of shafts. As is well known, if the cams are controlled to be rotated in a selected direction at selected times, the trays will function to receive sets of sheets in addressed fashion, i.e., as a mailbox.

SUMMARY OF THE INVENTION

The present invention addresses the need for an apparatus which is useful as a sorter but more particularly as a mailbox in which the sheets are supplied from a fixed inlet position to vertically movable trays operated by cam mechanisms which support the trays at opposite sides thereof to vertically move the trays, wherein the trays are configured in such a way as to enable, if desired, finishing of the sets of sheets, as by stapling, and wherein the trays are each provided with a shelf on which the sets of sheets are assembled at their tailing ends, while the leading ends of the sets are supported on the tray, wherein a stapler is movable to a position to insert a staple in the trailing end of the set while the trailing end is on the shelf, and subsequently to stapling, if stapling is desired, the set is pushed from the shelf at its trailing end and moves downwardly to rest at the lower end of the tray with which the shelf is integrated.

With such a construction the sets are finished or stapled and then moved upwardly or downwardly as may be required for sorting or random opening for mailboxing.

The unique configuration of the tray with an integral shelf from which the sets are displaced following stapling particularly enables the present apparatus to function well as a mailbox in that the trays may be randomly vertically shifted upwardly or downwardly depending upon the mailbox address of the respective trays.

Other features and objectives of the invention will become apparent or will be hereinafter described with reference to the drawings forming a part hereof.

DESCRIPTION OF THE PREFERRED EMBODIMENT

Figure 1:
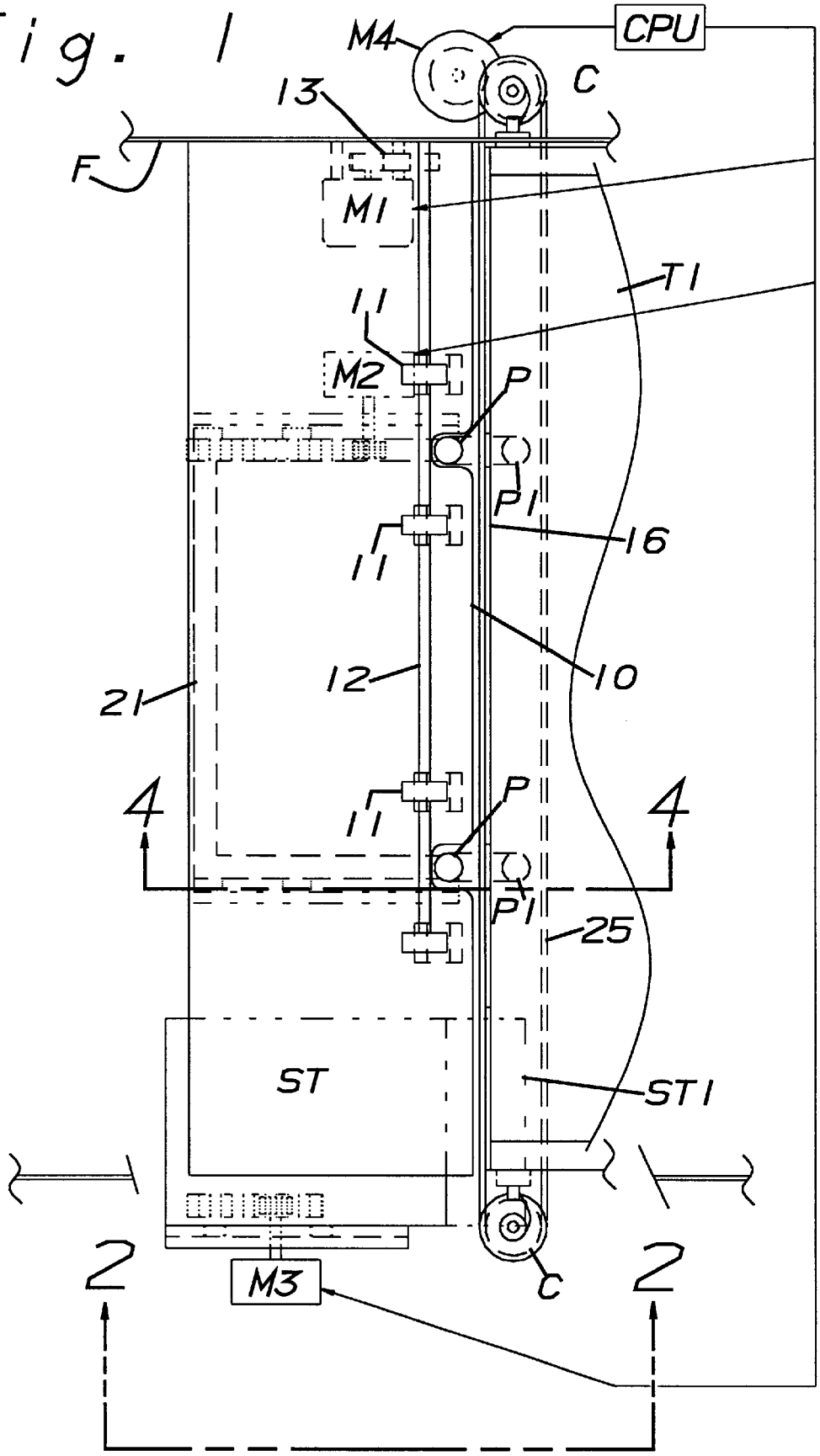
FIG. 1 is a top plan of the apparatus with the outer tray ends removed and a frame which is broken away.
Figure 2:
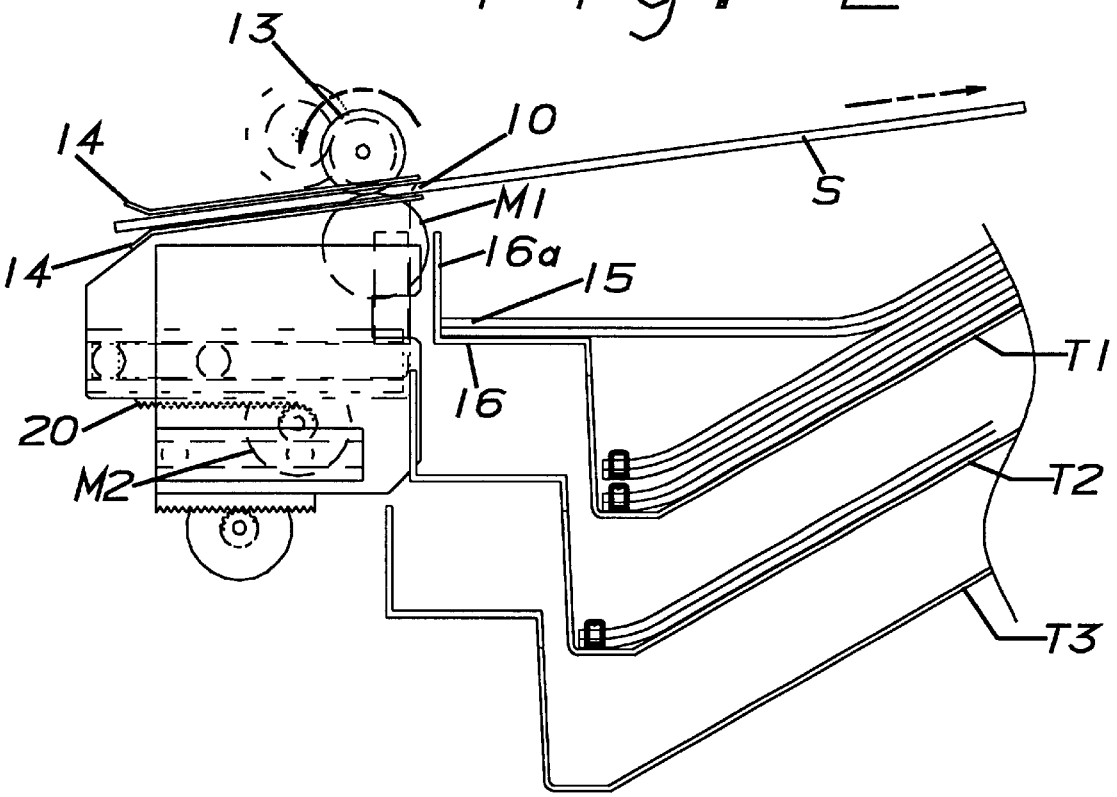
FIG. 2 is a side elevation as taken on the line 2—2 of FIG. 1, with parts broken away, showing a sheet being fed into the top tray for assembly of the trailing end on the integral shelf and with a finished set in a subjacent tray.

In FIG. 1, the top plan view illustrates the principle components of the apparatus as including a frame F, a tray T1 adapted to be sequentially or selectively moved vertically with other trays T2 and T3 as seen in FIGS. 2 through 5 past a sheet inlet 10 through which sheets S are adapted to be fed from a copier or printer as seen in FIG. 1, the means for moving the trays vertically past the inlet 10 includes rollers 11 mounted upon a transversely extended shaft 12 and adapted to be driven by a feed motor Ml through pinion and gear means 13 so that the sheets S are driven in the direction of the arrow in FIG. 2 through a pair of guide plates 14, 14.

An objective of the invention is to deposit sheets S with their trailing ends 15 upon an L-shaped shelf 16 which is an integral part of each of the trays T1 through T3 and which extend upwardly at an angle from the low point of the trays to a position above the level of the shelf 16. This geometry permits the forward or leading ends of the sheet S to be deposited upon the upwardly extended portion of the respective trays so that a downward gravity force is applied to the sheets to move them into trailing edge engagement with the vertical wall 16*a* of the shelf 16.

Figure 4:
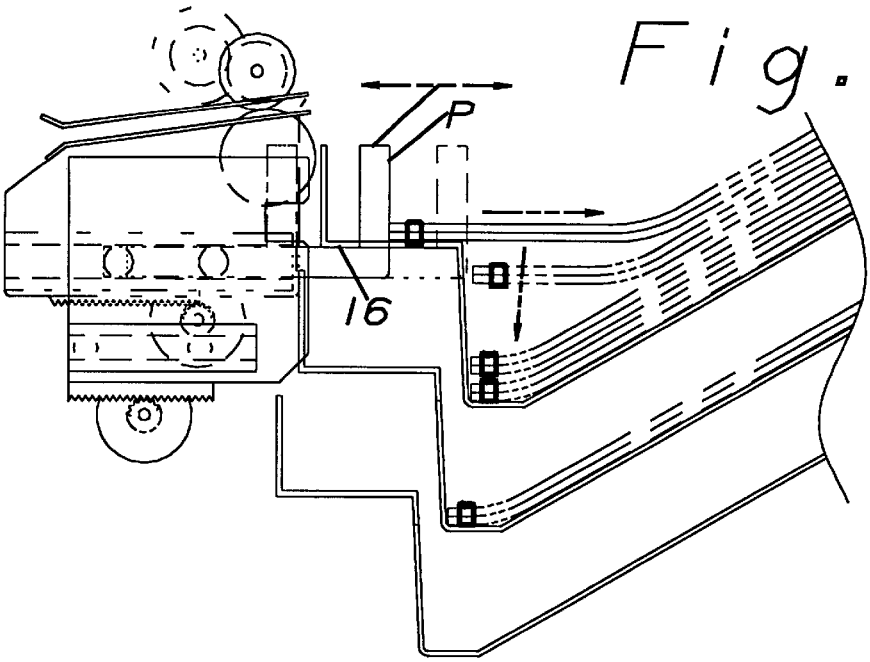
FIG. 4 is a view like FIG. 3, showing the finished set being pushed from the shelf for final receipt of the set in the tray.

In addition, the apparatus is provided with a number of pushers P which are adapted to be horizontally moved as seen in FIG. 4 and, as indicated by the arrow horizontally, so as to displace a set of sheets from the shelf 16. The drive means for the pushers includes a pusher motor M2 and suitable gearing including a rack 20 which drives a support structure 21 for the two pushers P.

Figure 3:
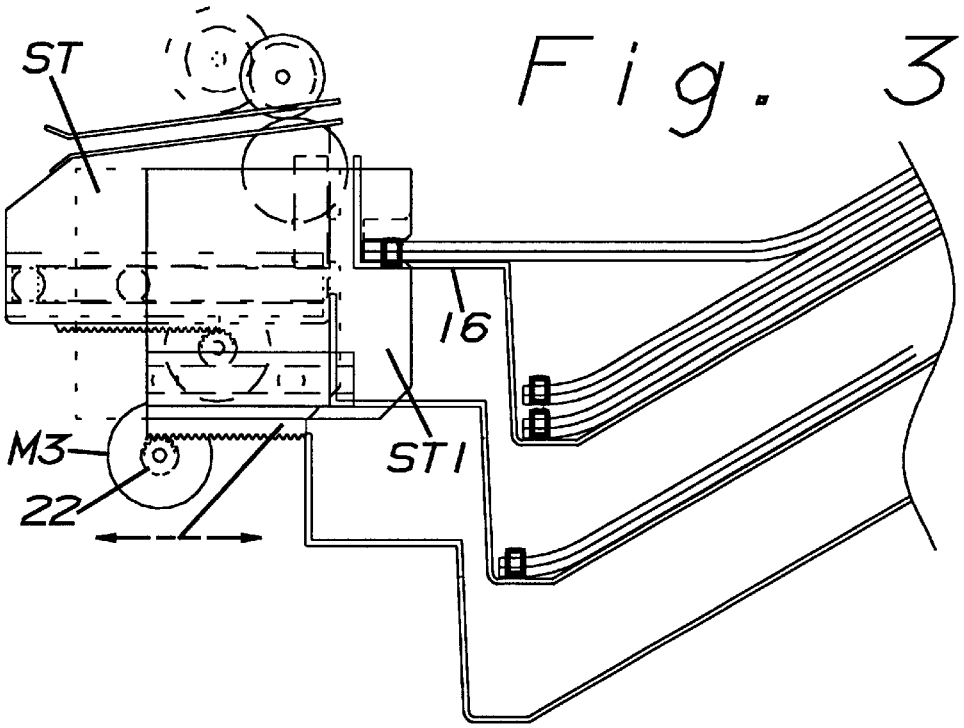
FIG. 3 is a view like FIG. 2, but showing the set being stapled on the integral shelf.

Prior to being pushed from the shelf 16 it is desired that the assembled sheets, as seen in FIG. 3, are finished or stapled by means of a stapler ST which is mounted for horizontal translation as indicated by the arrow in FIG. 3, and adapted to be driven by a motor M3 and pinion and rack gearing 22. As best seen in FIG. 3, the trailing ends of a set of sheets are stapled while resting on the shelf 16 as seen in FIG. 3.

To permit the movement of the pushers P and the stapler ST the necessary distance from an inoperative position to the left of the vertical wall 16*a* of the shelf 16, the wall 16*a* has openings P1 for the pushers and ST1 for the stapler and the openings P1 and ST1 extend to the right to provide adequate space in the shelf 16 for displacement of the stapled sets from the shelf as well as movement of the stapler ST to the stapling position prior to displacement of the sets from the shelf 16.

Figure 5:
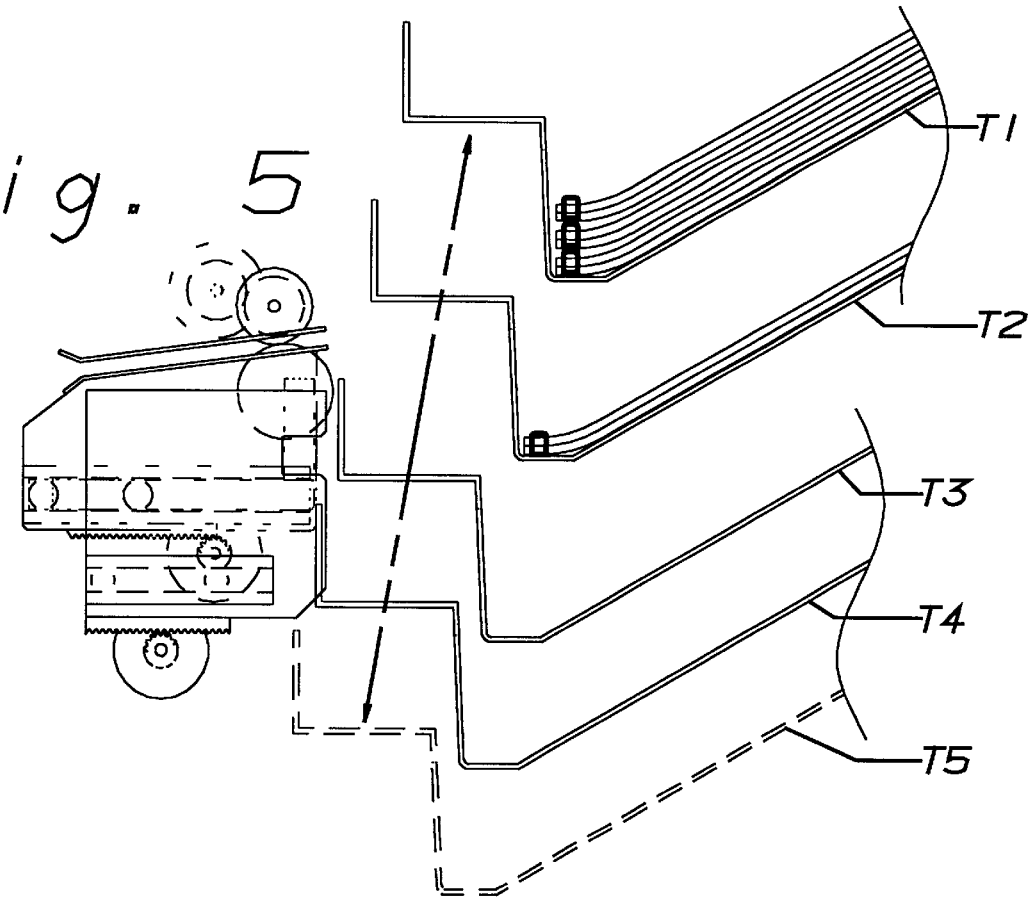
FIG. 5 is a view like FIG. 4, showing upward movement of the two upper trays and movement of an additional tray to a position for receiving sheets.

As best seen in FIG. 5, the trays T1, T2 and T3 have been moved upwardly as indicated by the arrow by the action of the cams C supported at opposite sides of the trays and adapted to be driven by a motor M4 and a drive chain or belt 25 which extends horizontally beneath the trays so as to drive the cams C in unison. Such cams are disclosed with greater detail in numerous patents owned by the owner of the present application including U.S. Pat. No. 5,255,902 referred to at the commencement of this application and to which reference may be had for an illustration of various cam means for moving the trays vertically upwardly and downwardly in sequence to function as a sorter or in a random fashion to function as a mailbox, all as may be directed by a CPU which is actuated to control the operation of all of the drive motors M1, M2, M3 and M4.

As a result of the construction of the apparatus as described above, it will be seen in FIG. 2 and a number of sets may have been previously stapled and deposited in the tray T1 below the shelf 16 while additional sheets are being supplied through the infeed 10 to make up a complete set which then is stapled as sown in FIG. 3 and displaced from the shelf 16 as seen in FIG. 4 prior to, as illustrated in the respective trays T1, T2 and T3, as well as additional trays T4 and T5, the number of trays being not material to the present invention, and wherein the tray T3 has been positioned, as seen in FIG. 5, to receive an incoming set.

It will also be noted that in the Tray T2 only one set has been formed, stapled and displaced into the tray T2 indicating that the trays may have different mailbox addresses as is well known in the art.

Having thus described the invention, the subject matter thereof is best described in the appended claims.

What is claimed is:

1. In a set finishing machine having a plurality of trays vertically movable to positions above and below a sheet inlet location, the improvement wherein each tray has integral therewith an L-shaped shelf for receiving the trailing ends of sheets supplied thereto at said inlet location and a tray section extending outwardly and upwardly at an angle to a location above said shelf for supporting the leading ends of the sheets, means for horizontally displacing the sets from said shelf onto said tray, and means for selectively stapling sets of sheets on said shelves prior to displacement of the sets therefrom.

2. In a set finishing machine as defined in claim 1, said trays being vertically movable by rotary cams and a motor to drive said cams in opposite rotary direction.

3. In a set finishing machine as defined in claim 1, said trays being vertically movable by rotary cams and a motor to drive said cams in opposite rotary directions to move said trays sequentially or randomly.

4. In a set finishing machine as defined in claim 1, said trays being vertically movable sequentially or randomly.

5. In a set finishing machine as defined in claim 1, said L-shaped shelves having areas removed to permit movement of said means for horizontally displacing said sets into engagement with the trailing ends of said sets to displace said sets from said shelves.

6. In a set finishing machine as defined in claim 1, said L-shaped shelves having areas removed to permit movement of said means for horizontally displacing said sets into engagement with the trailing ends of said sets to displace said sets from said shelves and to permit movement of said means for selectively stapling said sets to and from positions for driving staples into said sets.

7. In a set finishing machine as defined in claim 1, said trays being vertically movable sequentially or randomly, and said L-shaped shelves having areas removed to permit movement of said means for horizontally displacing said sets into engagement with the trailing ends of said sets to displace said sets from said shelves.

8. In a set finishing machine as defined in claim 1, said trays being vertically movable sequentially or randomly, and said L-shaped shelves having areas removed to permit movement of said means for horizontally displacing said sets into engagement with the trailing ends of said sets to displace said sets from said shelves and to permit movement of said means for selectively stapling said sets to and from positions for driving staples into said sets.

9. In a set finishing machine as defined in claim 1, said trays being vertically movable by rotary cams and a motor to drive said cams in opposite rotary directions, and said L-shaped shelves having areas removed to permit movement of said means for horizontally displacing said sets into engagement with the trailing ends of said sets to displace said sets from said shelves.

10. In a set finishing machine as defined in claim 1, said trays being vertically movable by rotary cams and a motor to drive said cams in opposite rotary directions to move said trays sequentially or randomly, and said L-shaped shelves having areas removed to permit movement of said means for horizontally displacing said sets into engagement with the trailing ends of said sets to displace said sets from said shelves.

11. In a set finishing machine as defined in claim 1, said trays being vertically movable by rotary cams and a motor to drive said cams in opposite rotary directions, and said L-shaped shelves having areas removed to permit movement of said means for horizontally displacing said sets into engagement with the trailing ends of said sets to displace said sets from said shelves and to permit movement of said means for selectively stapling said sets to and from positions for driving staples into said sets.

12. In a set finishing machine as defined in claim 1, said trays being vertically movable by rotary cams and a motor to drive said cams in opposite rotary directions to move said trays sequentially or randomly, and said L-shaped shelves having areas removed to permit movement of said means for horizontally displacing said sets into engagement with the trailing ends of said sets to displace said sets from said shelves and to permit movement of said means for selectively stapling said sets to and from positions for driving staples into said sets.

* * * * *